US009493923B1

(12) United States Patent
Miller

(10) Patent No.: US 9,493,923 B1
(45) Date of Patent: Nov. 15, 2016

(54) INTERNALLY BRACED GEOSYNTHETIC WRAPPED SYSTEM FOR CONSTRUCTING STABILIZED-EARTH WALLS AND SLOPES

(71) Applicant: Stanley M. Miller, Moscow, ID (US)

(72) Inventor: Stanley M. Miller, Moscow, ID (US)

( * ) Notice: Subject to any disclaimer, the term of this patent is extended or adjusted under 35 U.S.C. 154(b) by 0 days.

(21) Appl. No.: 14/986,310

(22) Filed: Dec. 31, 2015

(51) Int. Cl.
*E02D 17/20* (2006.01)
*E02D 29/02* (2006.01)

(52) U.S. Cl.
CPC ..... *E02D 29/02* (2013.01); *E02D 29/0225* (2013.01)

(58) Field of Classification Search
CPC ..... E02D 17/20; E02D 17/202; E02D 29/02; E02D 29/0225
USPC ..... 405/262, 284, 302.4, 302.6, 302.7
See application file for complete search history.

(56) References Cited

U.S. PATENT DOCUMENTS

| | | | | |
|---|---|---|---|---|
| 3,686,873 | A | 8/1972 | Vidal | |
| 4,117,686 | A | 10/1978 | Hilfiker | |
| 4,329,089 | A | 5/1982 | Hilfiker | |
| 4,394,924 | A | 7/1983 | Zaccheroni | |
| D295,788 | S | 5/1988 | Forsberg | |
| 4,909,010 | A | 3/1990 | Gravier | |
| 4,920,712 | A | 5/1990 | Dean | |
| 5,333,970 | A | 8/1994 | Heselden | |
| 5,567,087 | A | 10/1996 | Theisen | |
| 5,616,399 | A | 4/1997 | Theisen | |
| 6,296,422 | B1 * | 10/2001 | Ferraiolo | E02D 29/0241 405/262 |
| 6,322,291 | B1 | 11/2001 | Rainey | |
| 6,595,726 | B1 | 7/2003 | Egan | |
| 6,893,193 | B2 | 5/2005 | Santha | |
| 8,197,159 | B2 | 6/2012 | Ridgway | |
| 8,226,330 | B2 | 7/2012 | Blouin | |
| 2005/0286981 | A1 | 12/2005 | Robertson | |
| 2006/0204343 | A1 | 9/2006 | Kallen | |
| 2013/0309012 | A1 * | 11/2013 | Lancaster | E02D 31/00 405/21 |

FOREIGN PATENT DOCUMENTS

| | | |
|---|---|---|
| EP | 0574233 | * 12/1993 |

* cited by examiner

*Primary Examiner* — Sunil Singh
(74) *Attorney, Agent, or Firm* — Leighton K. Chong

(57) ABSTRACT

A method of constructing an internally braced geosynthetic-reinforced earth zone and slope facing system uses a single-layered, three-dimensional, high-profile pyramidal-woven geotextile fabric in conjunction with a bracing assembly of bars inserted into the geotextile weave and bracing an upright fold of the geotextile fabric with soil backfill to form an upright geotextile layer or lift in a plurality of wrapped, reinforcement layers of an earth wall or steepened slope. The wrapped geotextile reinforced earth wall or slope system can be internally seeded during construction or externally hydro-seeded post-construction to form a vegetated facing. The wrapped geotextile lifts can be sandwiched around longer, supplemental geogrids that extend the width of the reinforced zone for taller slopes and walls.

13 Claims, 7 Drawing Sheets

Fold Geotextile to Standup the Upright Bar, then Engage its End "B" T- Connector into T- Slot of Horizontal Bar End "B"

INTERNALLY BRACED GEOSYNTHETIC WRAPPED SYSTEM FOR CONSTRUCTING STABILIZED-EARTH WALLS AND SLOPES

TECHNICAL FIELD

The present invention is directed to a method of constructing an internally braced geosynthetic-reinforced earth zone, allowing for vegetated, erosion-resistant facing for walls or reinforced slopes built with simply assembled components and without temporary, external formwork.

BACKGROUND OF INVENTION

Soil reinforcement with layers of man-made inclusions, such as steel strips, steel grids, geotextile fabrics, and polymeric geogrids, has been used in the earthwork industry for the past 40 years. The use of planar, horizontal reinforcing elements in a compacted soil backfill allows for the construction of mechanically stabilized earth (MSE) structures that include steepened slopes (known as reinforced soil slopes, or RSS) and near-vertical walls. Examples of facing materials used for such reinforced-earth structures include: pre-cast concrete panels, modular concrete blocks with interlocking features, wire panels formed into baskets containing stones or granular soil, coir fiber blocks, and geosynthetic wrapped facing. Example U.S. patents for such prior art are listed below:

- U.S. Pat. No. 3,686,873 to Vidal (pre-cast concrete panels for facing elements)
- U.S. Pat. No. D295,788 to Forsberg (modular concrete block facing units)
- U.S. Pat. No. 4,909,010 to Gravier (modular concrete block facing units)
- U.S. Pat. No. 4,920,712 to Dean, Jr. (modular concrete block facing units)
- U.S. Pat. No. 6,322,291 to Rainey (modular concrete block facing units)
- U.S. Pat. No. 6,893,193 to Santha (coir fiber blocks restrained by coir twine/rope)
- U.S. Pat. No. 4,117,686 to Hilfiker et. al (wire panels formed into baskets filled with gravel or stones)
- U.S. Pat. No. 4,329,089 to Hilfiker et. al (wire panels formed into baskets filled with gravel or stones)
- U.S. Pat. No. 4,394,924 to Zaccheroni (wire panels formed into baskets filled with gravel or stones)
- U.S. Pat. No. 5,333,970 to Heselden (wire panels formed into baskets filled with gravel or stones)
- U.S. Pat. No. 6,595,726 to Egan and Anderson (wire facing connected to floor section)
- U.S. Published Application No. 20050286981 to Robertson and Ogorchock (wire mats formed into face-support structure)
- U.S. Published Application No. 20060204343 to Kallen (wire facing panels connected to geogrid)
- U.S. Pat. No. 8,197,159 to Ridgway (wire-panel facing unit with struts)
- U.S. Pat. No. 8,226,330 to Blouin (wire-panel facing with wire struts and fabric lining)

An alternative to the rigid wire-formed panel containment systems is the flexible wrap-face geotextile system. Wrapped geosynthetic faced MSE walls and slopes require temporary external bracing (falsework) at the face to support the soil being compacted immediately behind the geosynthetic facing, as illustrated in the steps depicted in FIG. 1. Reference is made to U.S. Dept. of Transportation, Publ. No. FHWA-NHI-00-043, p. 47, 2001. These often require a secondary, more permanent facing treatment, such as sprayed-on shotcrete or gunite on near-vertical faces and special seeding and erosion control treatments for reinforced slopes. Construction of a wrapped geosynthetic MSE structure consists of the consecutive lift sequences of: (1) compacting a lift of backfill soil, then installing a temporary face form (falsework) on the top of that lift, then laying the next horizontal geosynthetic on the backfill and hanging it over the falsework; (2) compaction of the next backfill lift, then wrapping of the geosynthetic back over the lift; (3) placing and compacting the remainder of the backfill lift over the wrap end. The falsework is removed prior to repeating the entire process for the next lift.

Regardless of the type of materials or construction method used conventionally for wrapped geosynthetic MSE structures, the soil-compaction process in the reinforced backfill zone near the final slope face requires that the face (or facing elements) be supported with temporary bracing (falsework). In addition, these wrapped MSE structures often are limited to linear alignments due to the manner in which the geosynthetic fabric is wrapped back over itself with each backfill lift. It would be highly desirable to provide a self-supporting facing system and method of installing each lift of a mechanically stabilized earth structure without the need for supporting each lift with temporary bracing (falsework). It also would be desirable to use nonmetallic components in the reinforcing system, thus eliminating concerns of corrosion and performance degradation especially in wet, marine, salty, or other corrosive environments. The present invention addresses these issues by providing new technology focused on an easy-to-assemble, metallic or nonmetallic internal bracing system for constructing wrapped-face geosynthetic walls and steepened slopes having porous, erosion resistant facings amenable to vegetation establishment and sustainability.

SUMMARY OF INVENTION

The present invention comprises a method of constructing an internally braced geosynthetic-reinforced earth zone and slope facing system using woven, three-dimensional geotextiles known as High Performance Turf Reinforcement Mats (HPTRM) in conjunction with internal braces inserted/woven into the geotextile and spaced uniformly along a given horizontal layer or lift to form an upright geotextile face against which soil backfill can be placed and compacted as wrapped lifts are added consecutively on top of one another to build the reinforced-earth wall or steepened slope. HPTRM fabrics conventionally are rolled erosion control products installed flat along a ground surface (such as on a slope or as a lining along a stream channel) to prevent soil erosion by providing mechanical support to newly seeded vegetation as it grows into and through the porous fabric. Therefore, this present invention is a new application of HPTRM's in a novel and unique MSE system whereby upright supporting braces are woven into the HPTRM geotextile fabric to form the MSE facing and the soil geosynthetic reinforcement zone, thus 1) eliminating the need of temporary external formwork during soil compaction in the case of a geotextile wrapped wall, 2) providing a much simpler installation than assembling wire-form panels and including a fabric liner in the case of rigid wire mesh MSE options wherein soil backfill and vegetation establishment are planned, and 3) providing a self-supporting MSE system with contained soil as a grow medium compared to inert modular concrete blocks or solid coir blocks.

In a preferred embodiment, the HPTRM used as both the facing and the soil-reinforcement layers is a pyramidal-woven, single-layered, three-dimensional, high-profile HPTRM (U.S. Pat. Nos. 5,567,087 and 5,616,399 to Theisen), and commercially produced in two different weights, PYRAMAT® or LANDLOK® 3000). It is utilized as a plurality of wrapped, reinforcement layers in the soil backfill and also forming the external face of the reinforced-earth zone.

Furthermore, in a preferred embodiment, each internal brace comprises three like metallic or polymeric components or bars (made of materials such as high-density polypropylene/HDPE, acrylonitrile butadiene styrene/ABS, nylon, fiberglass, etc.) which are attached to the geotextile and assembled to form the completed upright angle-support. The horizontal and upright brace components are rigid, narrow bar-like members that are woven into the three-dimensional geotextile using the pyramidal projections, then interlocked and supported by a like bar, transversely connecting the two other components and forming the completed angle brace holding the geotextile upright, ready for soil backfilling. During installation, each angle brace locks itself into the three-dimensional geotextile and likewise prevents the geotextile from slipping or sagging on the upright section as it is moved into final position and soil backfill is placed against it and then compacted.

This new technology provides an engineered, UV-resistant (i.e., resistant to degradation caused by exposure to ultra-violet light), and erosion-preventive facing that can be pre-seeded with grasses or herbs immediately behind the geotextile within the soil backfill, hydroseeded externally after installation, and/or sprigged with live cuttings of plants in-between consecutive layers of the wrapped lifts during installation. Drip irrigation lines and spigots optionally may be added either internally or externally to the wrapped earth-support system to support initial vegetation growth and establishment.

Other objects, features, and advantages of the present invention will be explained in the following detailed description of the invention having reference to the appended drawings.

DETAILED DESCRIPTION

In the following detailed description of the invention, certain preferred embodiments are illustrated providing certain specific details of their implementation. However, it will be recognized by one skilled in the art that many other variations and modifications may be made given the disclosed principles of the invention.

Construction of a MSE wall or slope using the present invention to form a soil-reinforced zone provides a coherent gravity mass to resist overturning and sliding forces that result from the active earth pressure applied by the retained soil in the slope. The system relies on the synergy between the soil backfill and the wrapped pyramidal-woven geotextile, including the bottom extension, the upright facing, and the folded over (wrapped back) upper extension.

An example of a pyramidal-woven geotextile is described in U.S. Pat. Nos. 5,567,087 and 5,616,399 to Theisen, which are incorporated herein by reference. A method for stabilizing soil and reinforcing vegetation includes placing a single-layered, three-dimensional, high-profile woven geotextile fabric into the soil. The single-layered, homogeneous fabric is woven from monofilament yarns having different heat shrinkage characteristics such that, when heated, the fabric forms a thick three-dimensional, cuspated profile. The monofilament yarns have a relatively high tensile strength and a relatively high modulus at 10 percent elongation so as to provide a fabric which is greater in strength and more dimensionally stable than other geotextile structures. Thus, the geotextile fabric is suitable for use on slopes, ditches and other embankments and surfaces where erosion control, soil stabilization and/or vegetative reinforcement may be necessary. The homogeneous, single-component nature of the fabric promotes easier handling and minimizes failure points, while offering a thick, strong and dimensionally stable product upon installation.

Figure 1:
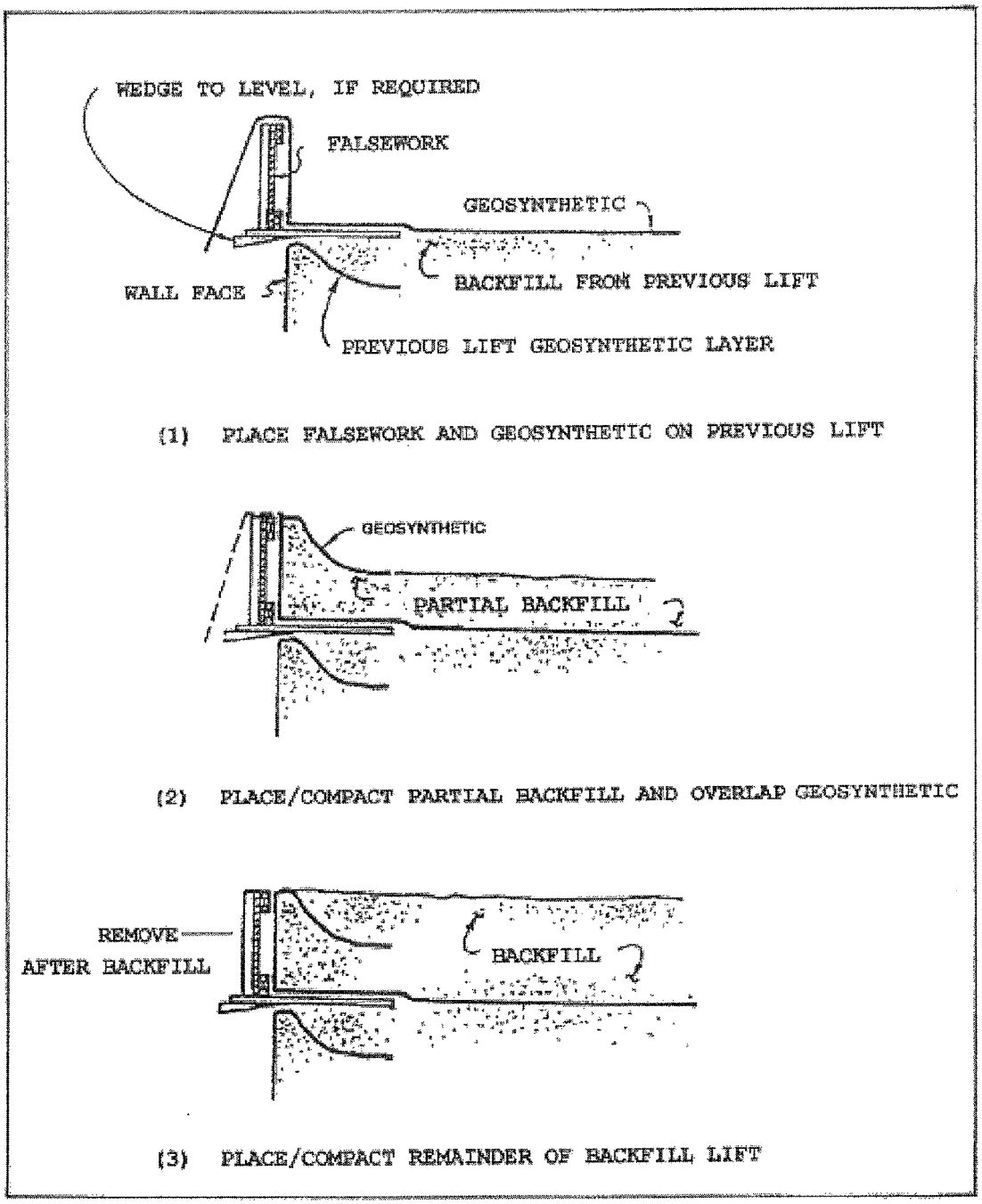
Figure 1 (PRIOR ART)
FIG. 1 illustrates a lift construction sequence in the prior art for geosynthetic, wrapped-face MSE walls.
Figure 2:
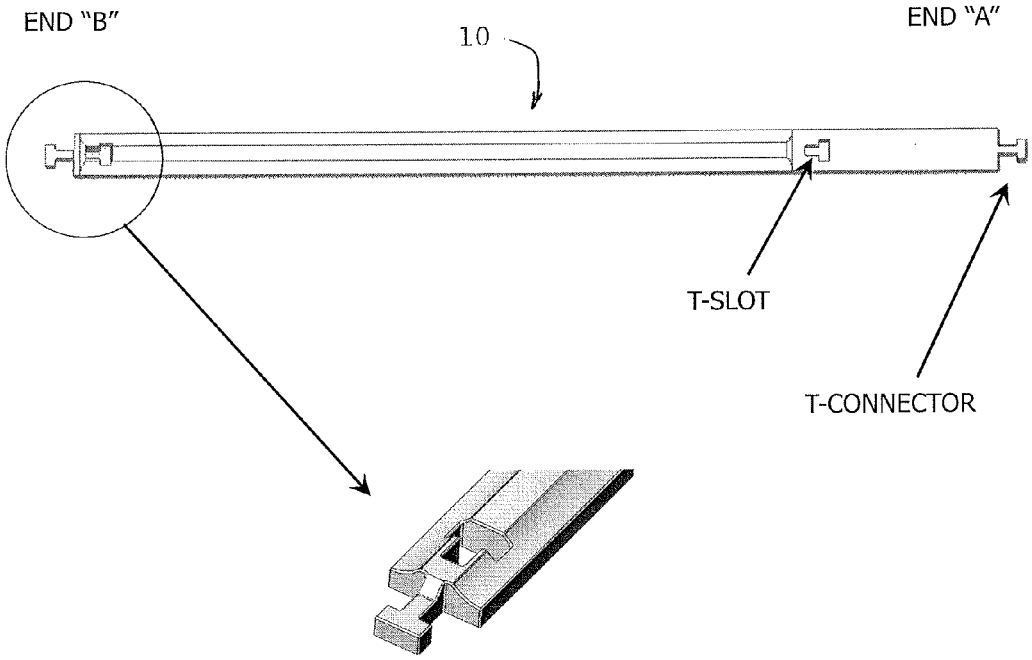
FIG. 2 illustrates the individual multi-use bar, three of which are used to form the internal angle brace
Figure 3:
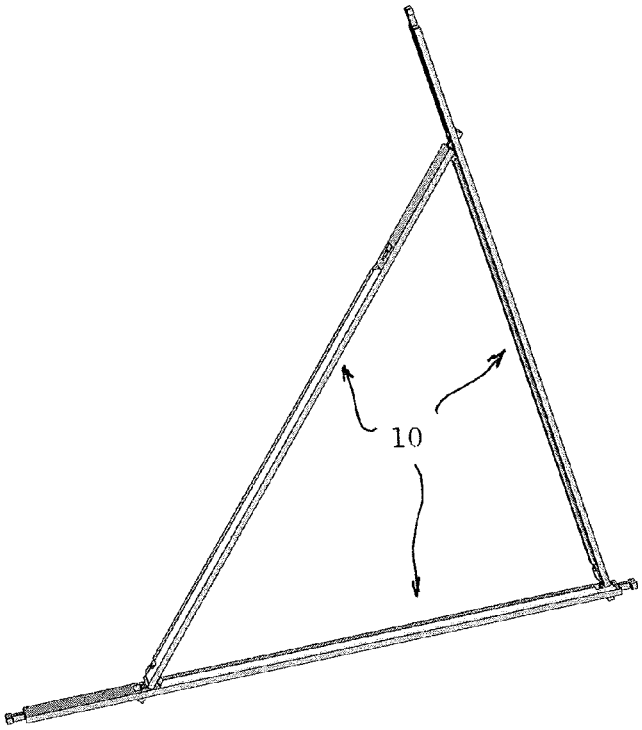
FIG. 3 illustrates how the bars' T-Connectors and T-slots are used to assemble the three bars into a completed angle brace (without showing the geotextile fabric)

Referring to FIG. 2 and FIG. 3, each bracing bar 10 of the bracing assembly is approximately 16-mm wide and 315-mm long, and it has specially designed T-ends (connectors) and T-slot holes allowing three like bars to snap together to form a completed angle brace. The bars have a specific width and cross-sectional shape allowing them to be easily inserted/woven through the pyramidal projections of the geotextile. Construction of a reinforced-earth wall or slope using the internal bracing bars in conjunction with the pyramidal-woven geotextile proceeds in the following steps:

(1) Prepare a subgrade leveling pad (typically 4-feet wide) along the proposed finished line of the wall face and excavated approximately 4 to 8 inches below original ground surface by removing topsoil and organic material. If additional over-excavation is needed to remove soft soil or deleterious material, then it should be replaced by compacted, structural fill approved by the Engineer. Rollout the pyramidal-woven HPTRM geotextile (nominal roll width is 8.5 feet) in a direction parallel to the wall or slope line and position the geotextile so that approximately 4 feet of its width extends from the line of the finished wall face into the backfill zone. The remaining 4.5 feet of the geotextile width temporarily extends out onto the ground in front of the wall line.

Figure 4A:
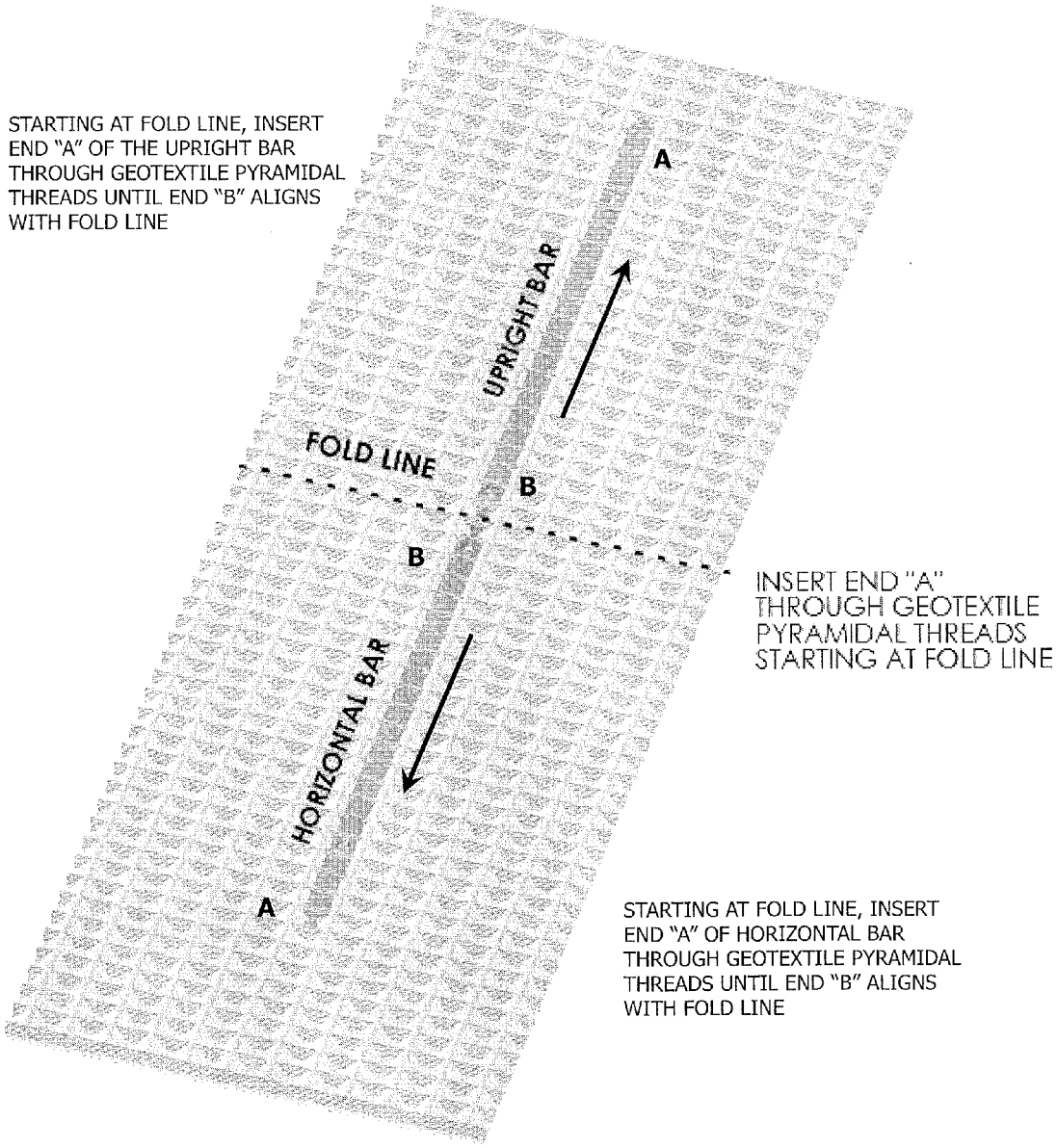
FIGS. 4A-4C illustrate the steps used to insert the bars through the pyramidal-woven geotextile and then connect them to form the upright assembly ready for soil backfill
Figure 4B:
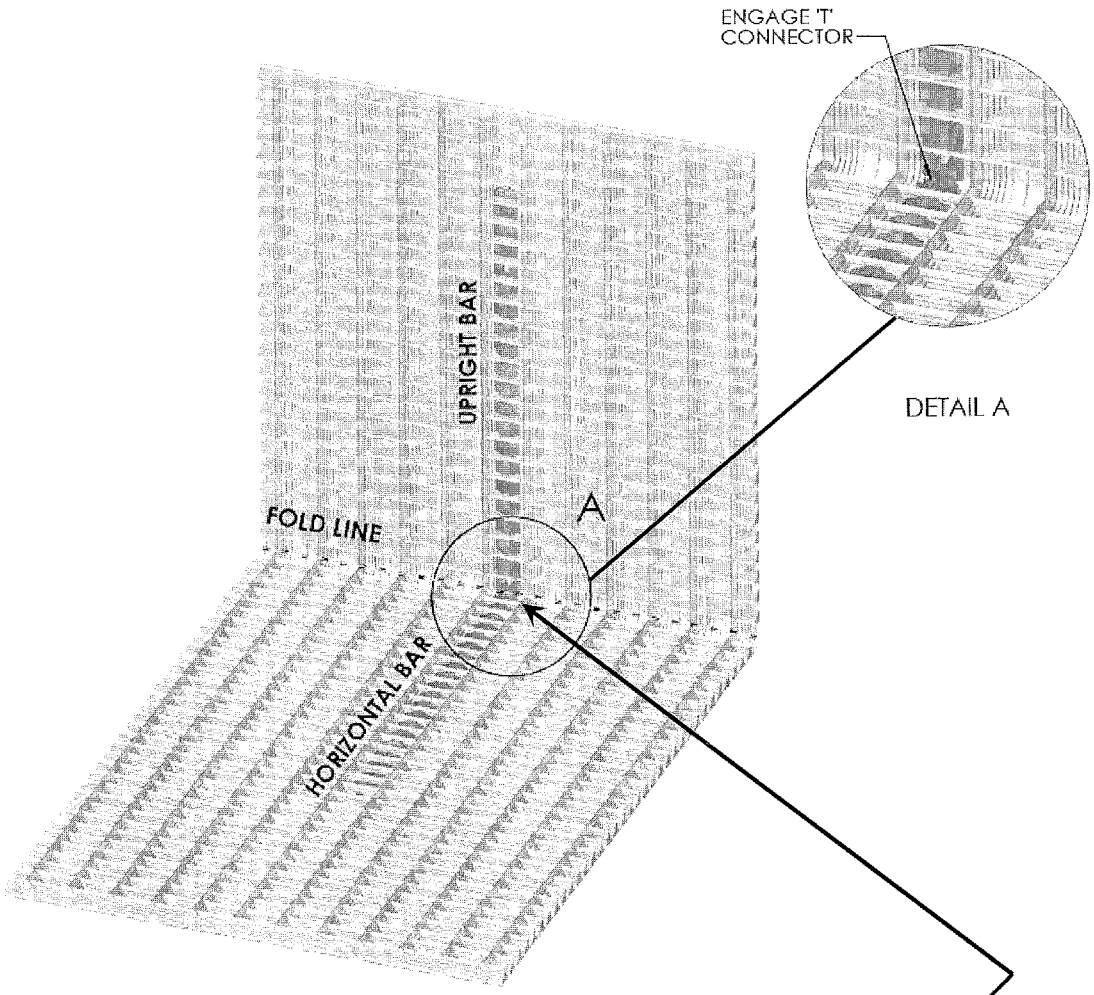
Figure 4C:
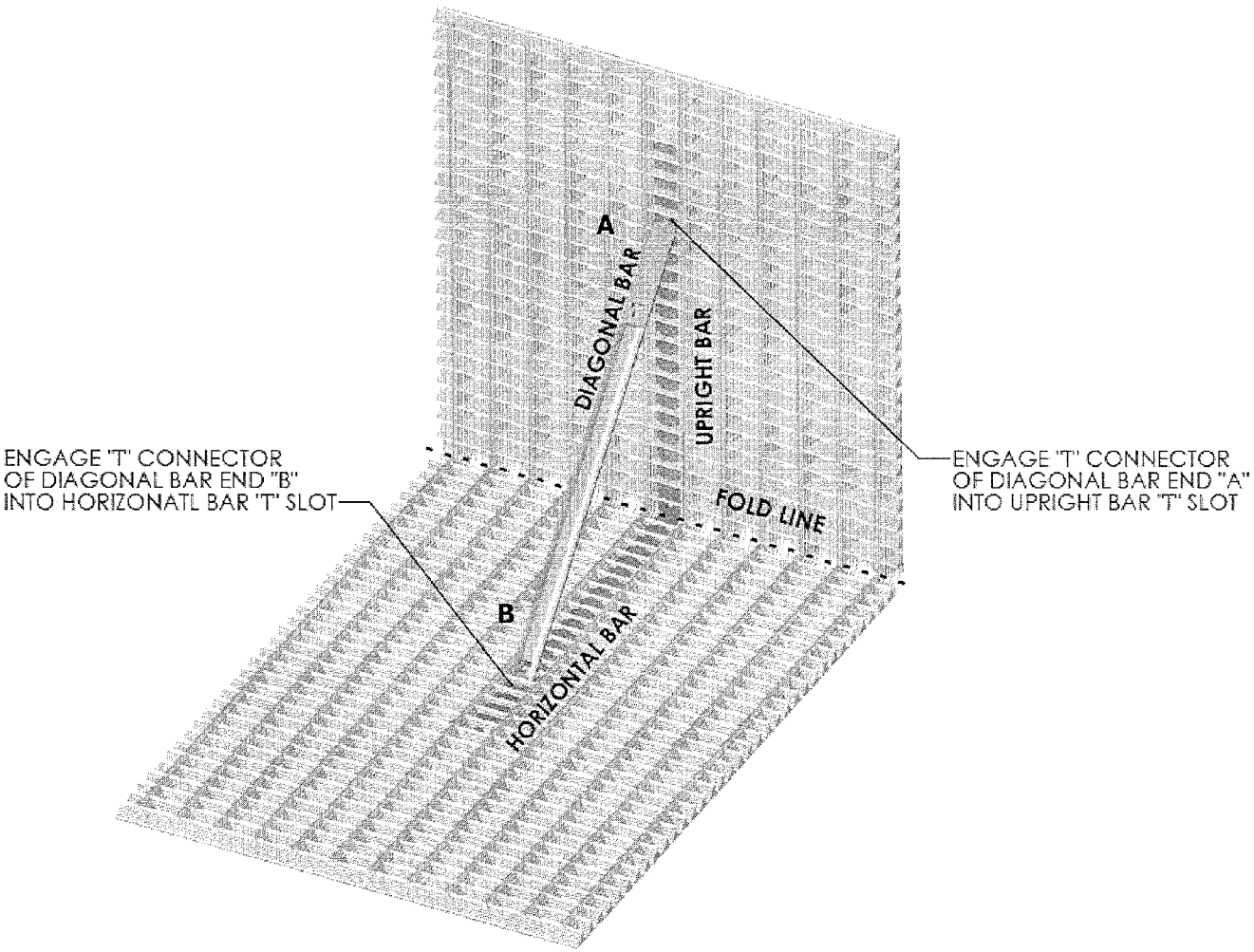

(2) At uniform spacings along the geotextile (typically ranging from 24 to 30 inches) and coincident with the wall-face line, install the lower-bar (horizontal) component of the angle brace by weaving it through the upraised pyramid shapes of the three-dimensional geotextile so that its front terminal end (End "B" as shown in FIG. 2 and FIG. 4A) aligns with the proposed wall-face line, or fold line. The bar should engage at least 6 of the longitudinal threads at each upraised fabric pyramid. Install the upright-bar component of the angle brace at the corresponding location by weaving it through a 12-inch face section starting at the fold line (FIG. 4A) that will form the subsequent upright portion of the wrapped lift. Individual bars are specifically shaped to facilitate insertion (weaving) through the pyramidal texture, and the T-slots are specifically located to align in-between the thread pattern (that is, at gaps in the thread pattern). Fold the geotextile to form the upright face section and insert the bottom T-connector (End "B") of the upright bar into the receiving T-slot (End "B") of the horizontal bar at the fold line (FIG. 4B). Then, install the diagonal brace bar by inserting its End "B" T-connector into the exposed T-slot of the horizontal bar and its End "A" T-connector into the exposed T-slot of the upright bar (FIG. 4C). The completed angle brace restrains the 12-inch geotextile face section at an upright angle of 0.15 H:1 V (horizontal:vertical), or 8.5 degrees past vertical, thus forming a inclined face back into the backfill area. This completes the assembly of the internal angle brace, and the same procedure is followed at each of the uniformly spaced locations along the wall face line.

(3) If the wall line is curved, then the HPTRM geotextile within the backfill zone is cut so that the fabric can be spread for the case of a concave wall line or can be overlapped for the case of a convex wall line. Cuts are made perpendicular to the wall face line and should not extend to that face line, but be terminated at least 8 inches away from the face line.

(4) Align the upright geotextile section with the planned final wall face line and place backfill soil approved by the Engineer behind the upright section and on top of the 4-foot wide geotextile within the backfill zone. If internal seeding is desired, scatter a row of seed immediately behind the 12-inch high upright geotextile face prior to placing the first lift of soil. Soil should be placed in loose, level lifts not exceeding 8-inches thick, then compacted to the Engineer's specification. Compaction equipment should be kept at least 3 inches away from the geotextile face. Prior to placing the second lift of soil to bring the backfill up to the top of the 12-inch upright geotextile face, a second row of seed can be scattered along the back of the upright face. The second lift of loose soil is placed such that its height is 1 to 2 inches above the 12-inch upright geotextile face to allow for compression during compaction. Compact this second lift according to the Engineer's specification. If internal seeding is desired, scatter a row of seed on the soil immediately behind the wall face line.

(5) Fold/wrap the remaining 3.5-foot wide loose portion of the geotextile back over the backfill zone and spread it out flat. For curved wall lines, this fabric should be cut in a similar fashion as described in Step (3). Smooth out any wrinkles (and optionally pin the geotextile to the ground while holding it taut) and cover it with a thin layer (0.5 to 1 inch) of backfill soil. The next vertical lift of geotextile fabric and backfill is placed slightly behind the previous wall face line to provide a set-back in the wall face, and is installed according to the previous Steps. Live vegetation in the form of sprigs or live cuttings can be inserted between lifts if desired.

Figure 5:
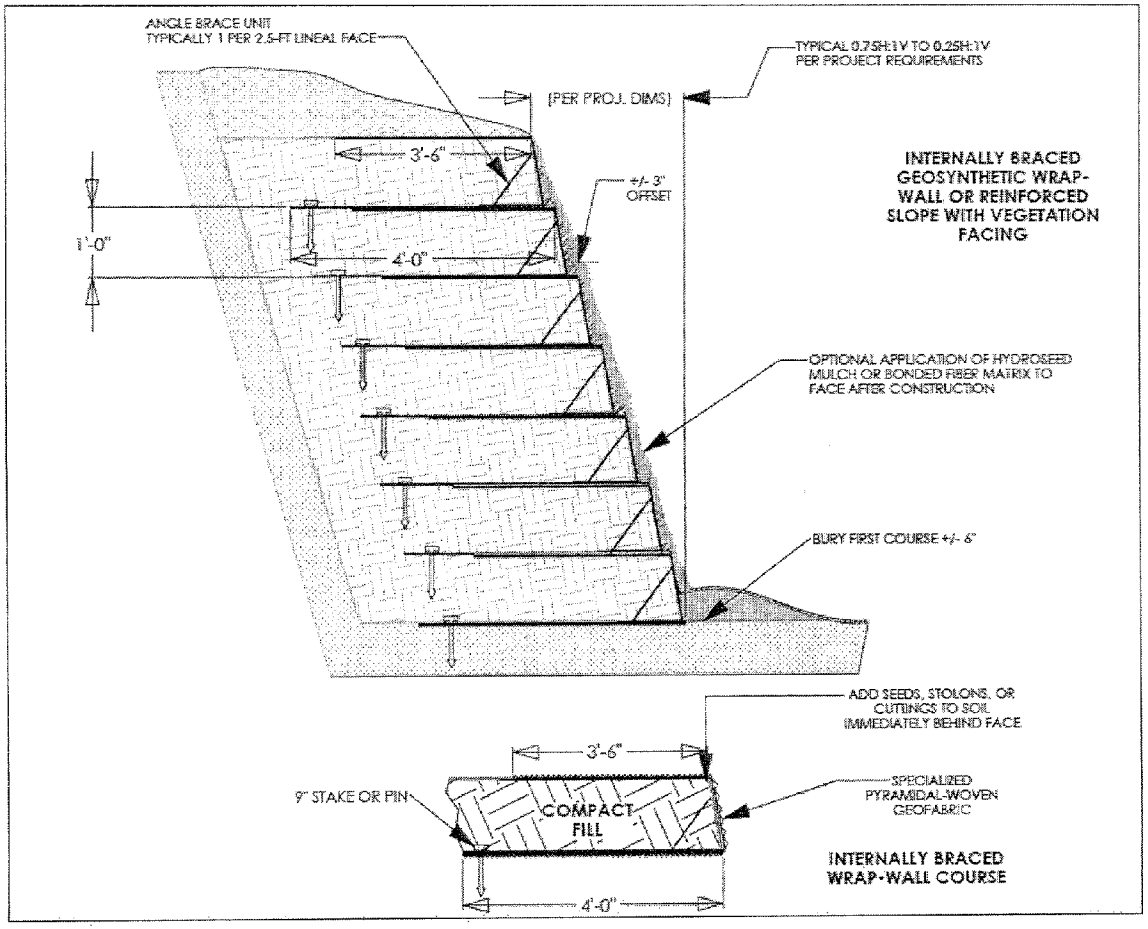
FIG. 5 is a schematic (cross-section) showing a typical constructed geosynthetic-reinforced earth structure using the internal braces and the pyramidal-woven geotextile

In similar manner, these Steps are repeated for each successive vertical lift with a given setback distance until reaching the final wall height and overall slope angle (FIG. 5) as specified by the design. Whenever consecutive geotextile layers directly overlap each other, they must be separated by a thin layer of soil to assure solid interlock of the geotextile with the backfill and to prevent the possibility of a weak shear plane being formed between two vertically adjacent geotextile layers. Whether or not internal seeding was accomplished, a typical option to establish vegetation at the wall face may be hydroseeding the wall face after the reinforced wall or slope is completed.

For wall heights greater than about 10 feet, the internal braced wrapped geotextile system can be combined with supplemental geogrid extensions to build tall composite, reinforced structures. The supplemental geogrids, which typically are spaced vertically at maximum intervals of 24 inches, butt up against the back of the wall facing and are sandwiched between the upper and lower geotextile layers of vertically adjacent lifts. Because they directly overlap each other, they must be separated by a thin layer of preferably granular soil to assure solid interlock of the geosynthetics with the backfill and with each other.

Reinforced-earth walls and slopes built with this internally-braced, wrapped geotextile system do no require any special construction equipment (bracing forms, temporary supports, falsework panels) or additional add-on pieces such as anchor cables or stakes. The system components can be nonmetallic, and when properly installed in conjunction with a compacted backfill zone, provide a durable, vegetated facing over an earth-reinforced wall or slope that can be installed by anyone with basic construction know-how and skill. Furthermore, the internally braced system performs independently from the type of backfill used; thus, backfill at the face can be selected for site specific applications, such as gravel for submerged shoreline sites, sand for beach stabilization, or a blend of granular soil and organic media (e.g., compost) to encourage vegetation growth.

It is to be understood that many modifications and variations may be devised given the above description of the general principles of the invention. It is intended that all such modifications and variations be considered as within the spirit and scope of this invention, as defined in the following claims.

The invention claimed is:

1. An internally braced geosynthetic-reinforced earth zone and slope facing system comprising:

(a) a three-dimensional, pyramidal-woven geotextile fabric laid down one on top of another with soil backfill on each fabric layer to form a plurality of wrapped, reinforcement layers with soil backfill forming a reinforced-earth zone in a plurality of layers together forming an external earth zone face; and (b) each fabric layer having a horizontal layer section and an external layer face formed by an upright fold of the geotextile fabric supported by a bracing assembly of three like bars, said bracing assembly comprising a horizontal bar inserted into the weave of the horizontal layer section of the geotextile fabric, an upright bar inserted into the weave of the upright fold of the geotextile fabric and having a proximal end thereof coupled by an end connector to a proximal end of the horizontal bar, and a bracing bar having opposite ends thereof coupled by end connectors to respective distal ends of the horizontal bar and the upright bar, whereby each fabric layer with soil backfill forms a horizontal reinforcement layer with an upright external layer face against which soil backfill is filled and compacted, and the plurality of reinforcement layers are added consecutively on top of one another to build the reinforced-earth zone as an earth wall or steepened slope.

2. An internally braced geosynthetic-reinforced earth zone and slope facing system according to claim 1, wherein said bars are made of non-metallic, rigid or semi-rigid material.

3. An internally braced geosynthetic-reinforced earth zone and slope facing system according to claim 2, wherein said bars are made of nylon or high-density polypropylene (HDPE).

4. An internally braced geosynthetic-reinforced earth zone and slope facing system according to claim 1, wherein each said bracing assembly is installed at uniform upright intervals along the earth wall face line to hold the geotextile fabric upright for containing backfill soil placed and compacted within the reinforced-earth zone.

5. An internally braced geosynthetic-reinforced earth zone and slope facing system according to claim 1, wherein said bracing assembly is used to form a sequenced horizontal earth layer in a plurality of layers for a geosynthetically stabilized earth wall or slope with vegetation establishment at the face.

6. An internally braced geosynthetic-reinforced earth zone and slope facing system according to claim 1, wherein in each said bracing assembly the horizontal bar and the upright bar are shaped with a flat rectangular cross-section allowing them to be inserted into the weave of upraised pyramids of the geotextile fabric and engage the fibers of the woven geotextile fabric.

7. An internally braced geosynthetic-reinforced earth zone and slope facing system according to claim 1, wherein said bracing bar is coupled to the horizontal and upright bars to form an angle about 8.5 degrees vertically inclined back toward the soil backfill.

8. A method of constructing a geosynthetic-reinforced earth wall or steepened slope comprising the steps of:

(a) laying out a first layer of three-dimensional geotextile fabric on a suitable leveling pad along a prescribed wall alignment, with a given roll width placed behind a wall face line within a planned reinforced backfill zone;

(b) installing at uniform spacings along the geotextile fabric and coincident with the wall-face line a horizontal bar by inserting it into a weave of upraised woven pyramid shapes of the three-dimensional geotextile fabric so that a front terminal end thereof aligns with the wall-face line, then installing an upright bar into the weave of upraised woven pyramid shapes of an upright fold of the three-dimensional geotextile fabric at a location corresponding to a proximal end of the horizontal bar starting at the wall-fold line, then installing a bracing bar diagonally with its opposite ends coupled by end connectors to respective distal ends of the horizontal bar and the upright bar;

(c) repeating the above steps to form each added fabric layer with soil backfill so that a plurality of reinforcement layers are added consecutively on top of one another to build the reinforced-earth wall or steepened slope.

9. A method of constructing a geosynthetic-reinforced earth wall or steepened slope according to claim 8, adapted for forming a vegetative facing wall wherein the geotextile fabric of each layer is internally pre-seeded or externally hydroseeded and provided with irrigation support to form a vegetated MSE wall or slope.

10. A method of constructing a geosynthetic-reinforced earth wall or steepened slope according to claim 8, adapted for forming a vegetative facing wall wherein live vegetation in the form of sprigs or live cuttings are inserted between lifts.

11. A method of constructing a geosynthetic-reinforced earth wall or steepened slope according to claim 8, wherein the geotextile layers are modified to form a curved wall having one of: (a) a concave shape with the geotextile layers being cut perpendicular to the wall face line to allow spreading of the geotextile to form concave curves, and (b) a convex shape with the geotextile layers being cut perpendicular to the wall face line to allow overlapping of the geotextile to form convex curves.

12. A method of constructing a geosynthetic-reinforced earth wall or steepened slope according to claim 8, wherein the backfill soil adjacent to each wall face is a material selected for a site specific application, including gravel for submerged shoreline sites, sand for beach stabilization, and a blend of granular soil and organic media such as compost for vegetation growth.

13. A method of constructing a geosynthetic-reinforced earth wall or steepened slope according to claim 8, wherein an earth wall is constructed using supplemental geogrid extensions to widen the geosynthetic-reinforced earth zone with the supplemental geogrid extensions being sandwiched in-between the geotextile fabric layers near the wall face.

* * * * *